US005403009A

United States Patent [19]

Gleason, Jr.

[11] Patent Number: 5,403,009

[45] Date of Patent: Apr. 4, 1995

[54] GOLF CLUB HEAD WEIGHTED COVER ASSEMBLY

[76] Inventor: Richard F. Gleason, Jr., 67 Stadium Way, Allston, Mass. 02134

[21] Appl. No.: 175,302

[22] Filed: Dec. 29, 1993

[51] Int. Cl.[6] ..... A63B 69/36

[52] U.S. Cl. ..... 273/194 B; 150/160; 482/109; 273/DIG. 30

[58] Field of Search ..... 273/194 B, DIG. 30; 150/160; 482/109

[56] References Cited

U.S. PATENT DOCUMENTS 2,737,394 3/1956 Abel ..... 273/194 B 4,164,969 8/1979 Dien ..... 150/160

5,094,283 3/1992 Lawrence ..... 150/160

5,230,512 7/1993 Tattershall ..... 273/DIG. 30

*Primary Examiner*—George J. Marlo

[57] ABSTRACT

A golf club head weighted cover assembly includes a cover, formed of flexible material, that defines both a volume sized for receiving a golf club wood or metal wood head and an opening sized for introducing the golf club head into the volume. The cross-sectional area of the opening about the golf club handle is reduced to restrict the unwanted removal of the golf club head from the cover, and a weight element releasably attaches to the bottom, outer surface of the cover.

7 Claims, 4 Drawing Sheets

GOLF CLUB HEAD WEIGHTED COVER ASSEMBLY

BACKGROUND OF THE INVENTION

The invention relates to golf club head covers.

Golf club head covers are typically open-ended bags constructed of a light weight, nonabrasive, pliable material, e.g. fabric or leather. In use such covers are generally slipped over the heads of clubs standing vertically in a golf club bag, protecting the heads from abrasion and other wear when the clubs are not in use. These covers are typically removed before the club is swung.

It is also known to use weights removably attached to the golf club during warm-up practice swings. These weights or "doughnuts" are typically vinyl-covered lead annuli each having an inner diameter slightly larger than the diameter of the club shaft, but smaller than the diameter of the club head. In use, a doughnut is slipped over the small-diameter end of the club handle and moved down the shaft until it rests against the upper surface of the club head. A golfer then takes practice warm-up swings using the weighted club-doughnut assembly.

SUMMARY OF THE INVENTION

According to the present invention, a golf club head weighted cover assembly comprises a cover element formed of flexible material, the cover element having an outer surface and defining a volume sized for receiving a golf club wood or metal wood head therewithin, and the cover element further defining an opening sized for introduction of the golf club head into the volume with a club handle extending through the opening; means for reducing the cross-sectional area of the opening about the golf club handle in a manner to restrict unwanted removal of the golf club head from within the volume; and a weight element adapted for releasable attachment upon the outer surface of the cover element.

Preferred embodiments of the present invention may include one or more of the following features. The weight element comprises a first element of a weight hook-and-loop type fastener set, and an opposed region of the outer surface of the cover element defines a complementary second element of the weight hook-and-loop type fastener set. The first element of the weight hook-and loop type fastener set defines a plurality of hooks, and the second element of the weight hook-and-loop type fastener set is provided by the flexible material of the cover element, and defines a plurality of loops.

Further, the means for reducing comprises a flexible strap having a first end attached to the cover element in the region of the opening, and a second end having means for releasable attachment about the opening. The means for releasable attachment of the strap comprises complementary first and second elements of a strap hook-and-loop type fastener set defined by opposed regions of the strap and the cover element. The first element of the strap hook-and-loop type fastener set defines a plurality of hooks, and the second element of the strap hook-and-loop type fastener set is provided by the flexible material of the cover element, and defines a plurality of loops.

Preferably, the golf club weighted cover assembly comprises a plurality of attachably removable cover elements.

Objectives of the invention include providing a golfer with the ability quickly and easily to select a desired golf wood or metal wood club weight when taking practice warm-up swings. Thus, the golfer can tailor the physical characteristics of the club to, e.g., provide a smooth and controlled practice swing that suitably exercises and limbers the appropriate muscles.

Further objectives of the invention include providing a golf club head weighted cover assembly that remains attached when the golf club is fully swung in an unrestricted normal manner.

Further objectives of the embodiments of the invention include providing a set of golf club wood or metal wood head covers among which one or several weight assemblies can be interchanged as necessary.

These and other advantages and features of the invention will be apparent from the following description of a presently preferred embodiment, and from the claims.

DESCRIPTION OF THE PREFERRED EMBODIMENTS

Referring to FIGS. 1–4, a golf club head weighted cover assembly 10 of the invention consists of one or a set of covers 12, each of which is a bag having a mouth 14 sized to fit over the head, H, of a golf wood or metal wood club, C. The covers 12 are formed of a flexible fabric material, e.g. nylon, cotton, leather, vinyl, or polyester, the outer surface 16 of which is covered with one or more regions of loops of the type to form a loop element of a hook-and-loop type fastener.

Figure 1:
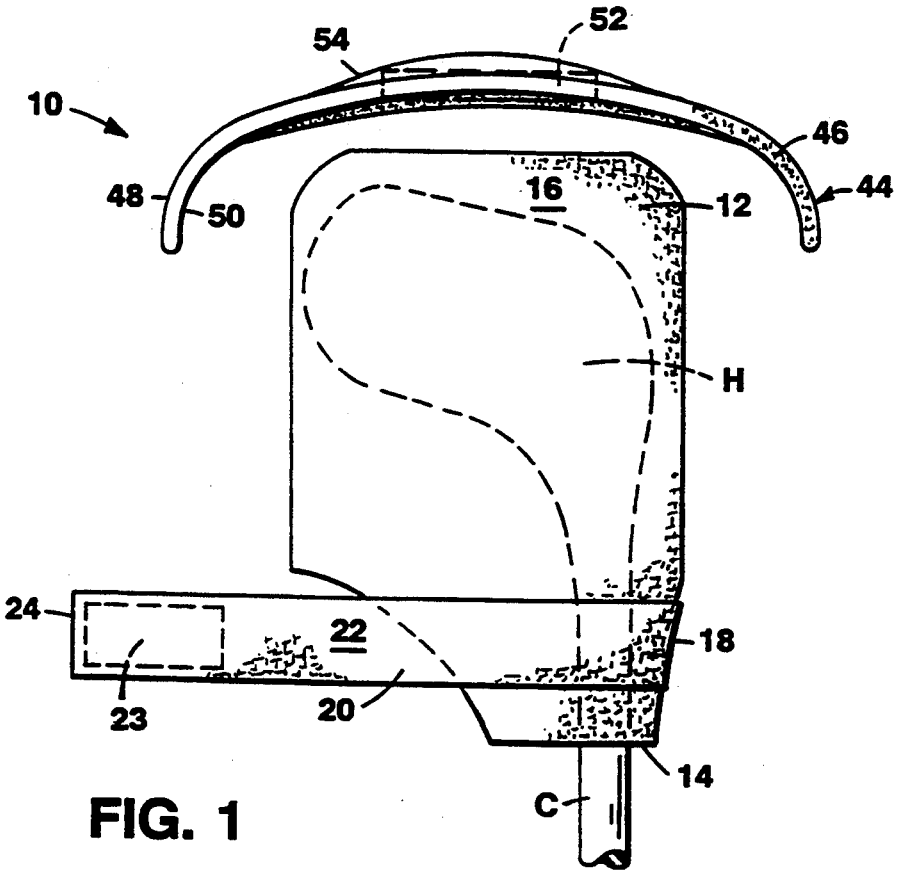
FIG. 1 is a front view of one embodiment of a golf club head weighted cover assembly of the invention disposed upon a golf club wood or metal wood head (shown partially in phantom)

Referring to FIG. 1, a first end 18 of an elongated flexible strap 20 having an outer surface 22, e.g., of fabric, is permanently attached, e.g. by sewing, to the cover 12 in the region of the mouth 14. At least a portion 23 of the second, free end 24 of the strap has an inner surface covered by hooks of the type to form a hook element of a hook-and-loop type fastener.

Figure 2:
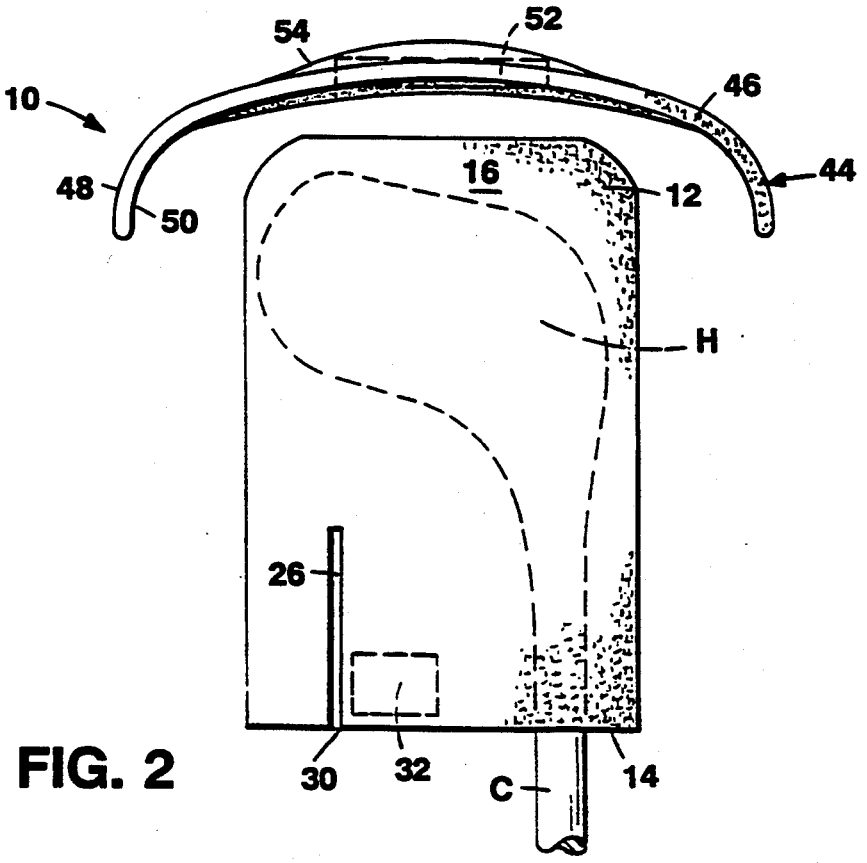
FIG. 2 is a similar view of another embodiment of a golf club head weighted cover assembly of the invention disposed upon a golf club wood or metal wood head (also shown partially in phantom)
Figure 3:
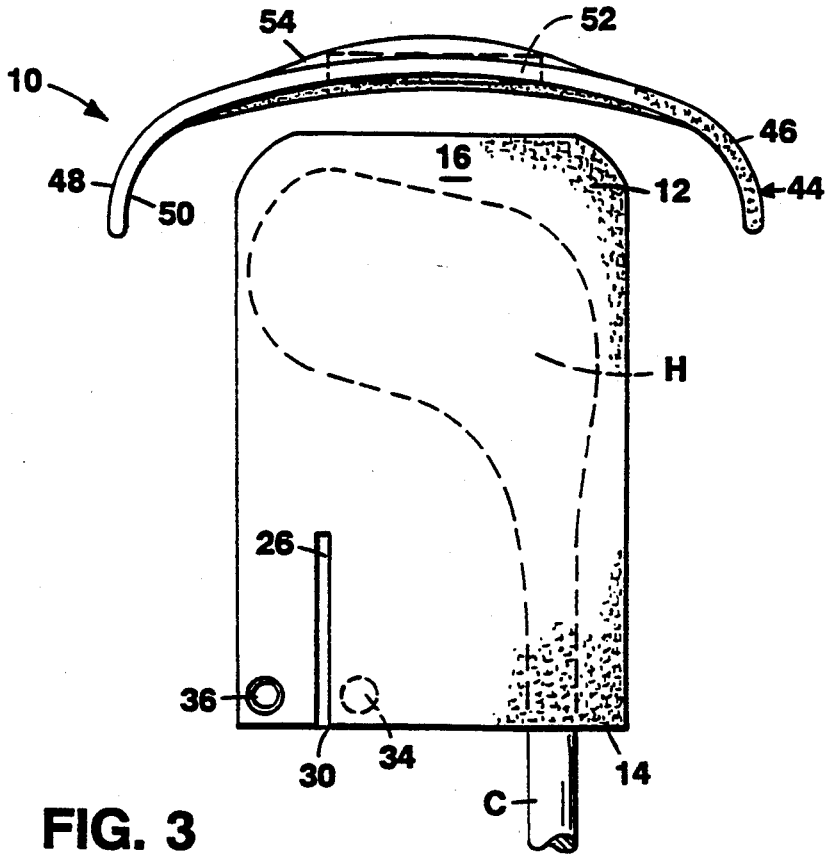
FIG. 3 is a similar view of another embodiment of a golf club head weighted cover assembly of the invention disposed upon a golf club wood or metal wood head (also shown partially in phantom)

Referring to FIGS. 2 and 3, a slit 26 beginning at the mouth 14 of each cover 12 extends approximately one-third of the distance to the closed end 28 of the cover 12, thereby forming a corner region 30 with the mouth 14. As shown in FIG. 2, at least a portion 32 of an inner surface of the corner region 30 is covered by hooks of the type to form a hook element of a hook-and-loop type fastener. As shown in FIG. 3, a male grommet snap fastener 34 is attached to the inner surface of the corner region 30, and a female grommet snap fastener 36 is attached to the outer surface of the cover 12 in the region of the mouth 14.

Figure 4:
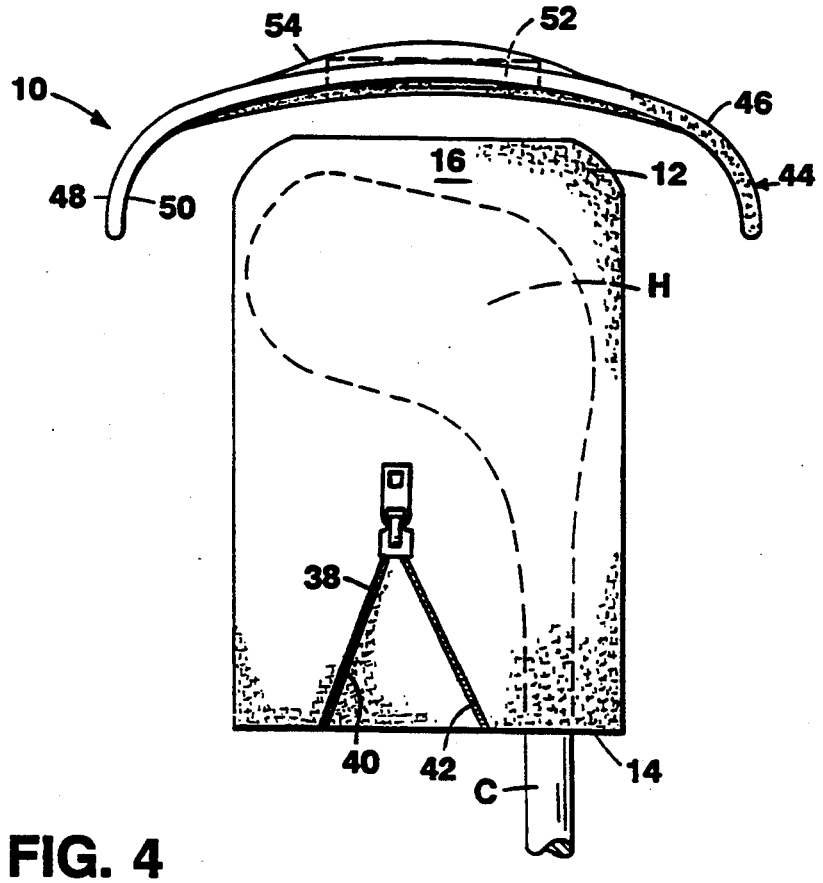
FIG. 4 is a similar view of another embodiment of a golf club head weighted cover assembly of the invention disposed upon a golf club wood or metal wood head (also shown partially in phantom)

Referring to FIG. 4, a zipper 38 extends from the mouth 14 of the cover 12 approximately one-third of the distance to the closed end 28 of the cover 12. When unzipped (shown), the unengaged ends 40, 42 of the zipper lie in spaced-apart relation at the mouth 14 of the cover 12.

Referring to FIGS. 1–5, a weight assembly 44 consists of an elongated flexible body 46 having an outer surface 48, e.g. of fabric, and an inner surface 50 at least a portion of which is covered by hooks of the type to form a hook element of a hook-and-loop type fastener. A weight 52 is attached upon the outer surface 48 of the strap, e.g., by sewing it in beneath a sheet 54 of leather, vinyl, or other scuff-resistant, flexible material.

In use, a golfer places a cover 12 over the head H of each golf wood or metal wood club C and secures it, e.g. by gathering the mouth 14 of the cover 12 about the club handle and wrapping the strap 20 around the gathered region to engage either the hook element inner surface portion 22 with the loop element outer surface 16 of the cover 12; or by wrapping the corner region 30 of the mouth 14 about the club handle and engaging the male 34 and female 36 grommet fasteners or the hook element inner surface portion 32 with the loop element outer surface 16 of the cover 12; or by zipping the zipper 38. The golfer then attaches the weight assembly 44 to the closed end 28 of the cover 12 by engaging the hook element inner surface 50 of the body 46 with the loop element outer surface 16 of the cover 12. The golfer can then take practice swings with the advantage of the extra weight.

Other embodiments are within the following claims. For example, one skilled in the art would also readily appreciate that there exist many alternative means for suitably reducing the cross-sectional area of the mouth 14 in order to restrict unwanted removal of the golf club head H from the cover 12.

Figure 7:
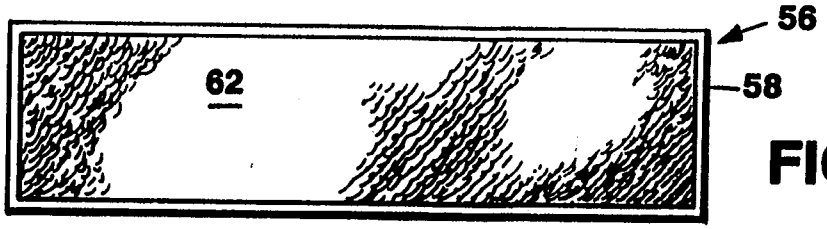
FIG. 7 is a plan view of a strap of the golf club head weighted cover assembly of FIG. 6.
Figure 5:
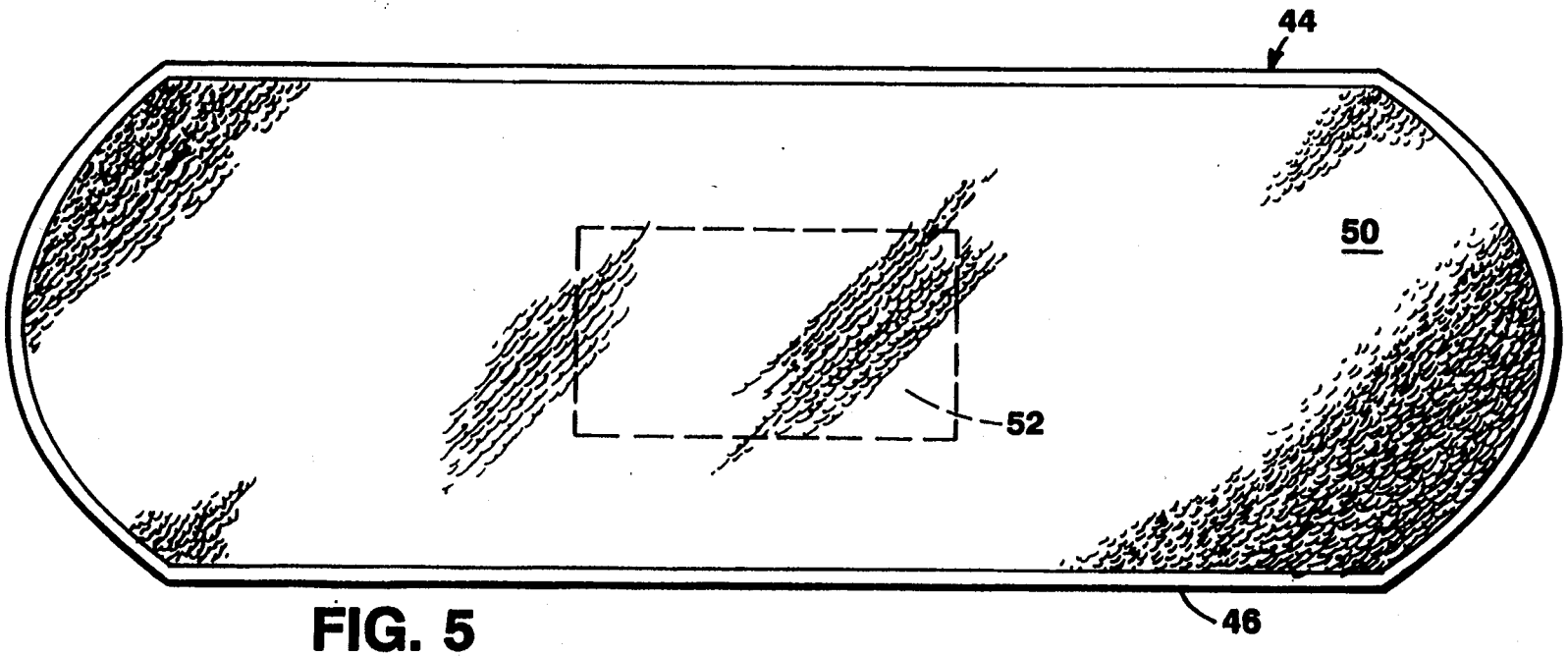
FIG. 5 is a plan view of a weight assembly of the golf club head weighted cover assembly of FIGS. 1–4 and FIG. 6.
Figure 6:
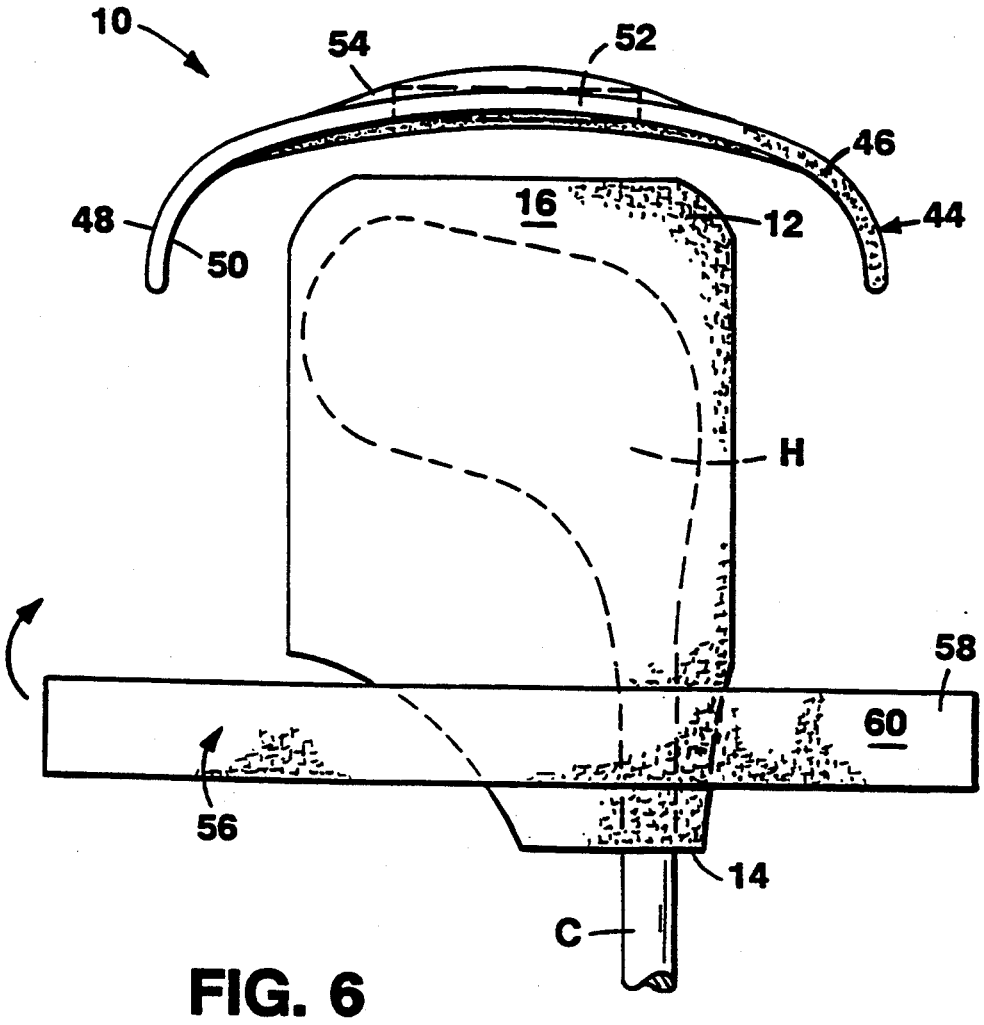
FIG. 6 is a front view of another embodiment of a golf club head weighted cover assembly of the invention disposed upon a golf club wood or metal wood head (also shown partially in phantom)

For example, referring to FIGS. 5–7, alternatively the golf club head weighted cover assembly 10 includes a strap 56 entirely detachable from the cover 12. The strap 56 consists of an elongated flexible body 58 having an outer surface 60, e.g. of fabric, and an inner surface 62 covered by hooks of the type to form a hook element of a hook-and-loop type fastener. In this embodiment, optionally the weight assembly 44 and strap 56 may be integrated into a single flexible body.

To illustrate further, alternatively the cover 12 may includes a drawstring slidably disposed within a channel encircling the mouth 14 of the cover 12.

What is claimed is:

1. A golf club head weighted cover assembly comprising:

a cover element formed of flexible material, the cover element having an outer surface and defining a volume sized for receiving a golf club wood or metal head therewithin, and the cover element further defining an opening sized for introduction of the golf club head into said volume with a club handle extending through said opening, means for reducing the cross-sectional area of said opening about the golf club handle in a manner to restrict unwanted removal of the golf club head from within said volume, and a flexibility to generally conform to the shape of the club head and being of sufficient weight to convert said golf club to a relatively heavy practice club for warm-up swings, and means for alternatively adhering a substantial surface portion of said weight element to said cover element so that the golf club may be fully swung in an unrestricted normal manner without said weight element becoming detached from said cover element and separating said weight element from said cover element when desired.

2. The golf club head weighted cover assembly of claim 1, wherein said weight element comprises a first element of a weight hook-and-loop type fastener set and an opposed region of the outer surface of said cover element defines a complementary second element of the weight hook-and-loop type fastener set.

3. The golf club head weighted cover assembly of claim 2, wherein said first element of said weight hook-and loop type fastener set defines a plurality of hooks and said second element of said weight hook-and-loop type fastener set is provided by said flexible material of said cover element and defines a plurality of loops.

4. The golf club head weighted cover assembly of claim 1, wherein said means for reducing comprises a flexible strap having a first end attached to said cover element in the region of said opening, and a second end having means for releasable attachment about said opening.

5. The golf club head weighted cover assembly of claim 4, wherein said means for releasable attachment of said strap comprises complementary first and second elements of a strap hook-and-loop type fastener set defined by opposed regions of said strap and said cover element.

6. The golf club head weighted cover assembly of claim 5, wherein said first element of said strap hook-and-loop type fastener set defines a plurality of hooks and said second element of said strap hook-and-loop type fastener set is provided by said flexible material of said cover element and defines a plurality of loops.

7. A set of golf club head covers each including the cover elements and weight elements recited in any preceding claim.

* * * * *